United States Patent [19]

Lönnstedt

[11] 4,287,614

[45] Sep. 8, 1981

[54] FASTENING MEANS FOR FITTING AN ACCESSORY, ESPECIALLY AN EAR MUFF, TO A SAFETY HELMET

[76] Inventor: Bo G. Lönnstedt, Kvarnbergsvägen 23, S-14145 Huddinge, Sweden

[21] Appl. No.: 151,595

[22] Filed: May 20, 1980

[30] Foreign Application Priority Data

May 28, 1979 [SE] Sweden ..... 7904611

[51] Int. Cl.[3] ..... A42B 3/00; A42B 1/24

[52] U.S. Cl. ..... 2/423; 2/209; 179/156 R

[58] Field of Search ..... 2/209, 423, 6, 422, 2/10; 179/156 R

[56] References Cited

U.S. PATENT DOCUMENTS 4,027,341 6/1977 Patteri ..... 2/209 X

FOREIGN PATENT DOCUMENTS 2719503 11/1978 Fed. Rep. of Germany ..... 2/423

*Primary Examiner*—Peter P. Nerbun

*Attorney, Agent, or Firm*—Young & Thompson

[57] ABSTRACT

A fastening means for fitting an ear muff to a safety helmet has an arm which is mounted in a housing intended for attaching to the helmet. A pivoting end portion of the arm situated in the housing is acted on by a disc-type spring means arranged in the housing. The line of action of the spring force has a decreasing leverage to the pivoting location of the arm for increasing arm swing-out, the pivoting moment exercised by the spring means on the arm being substantially constant within a swing-out range normal for the arm when it is in use. This results in a contact force for the ear muff which is essentially independent of the amount of swing-out.

9 Claims, 11 Drawing Figures

Figure 5:
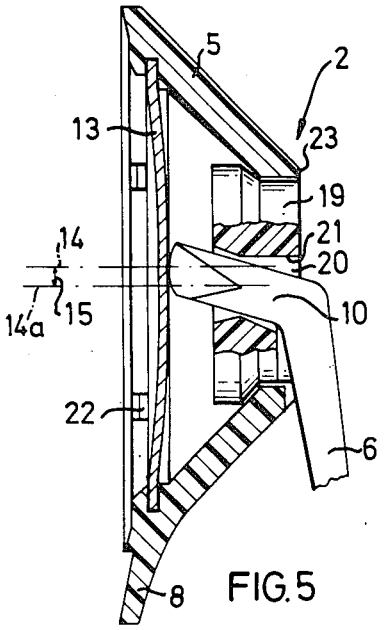

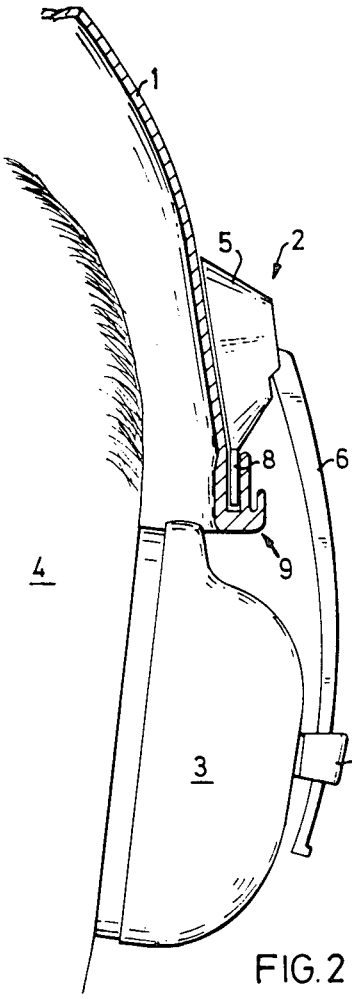
FIG. 1
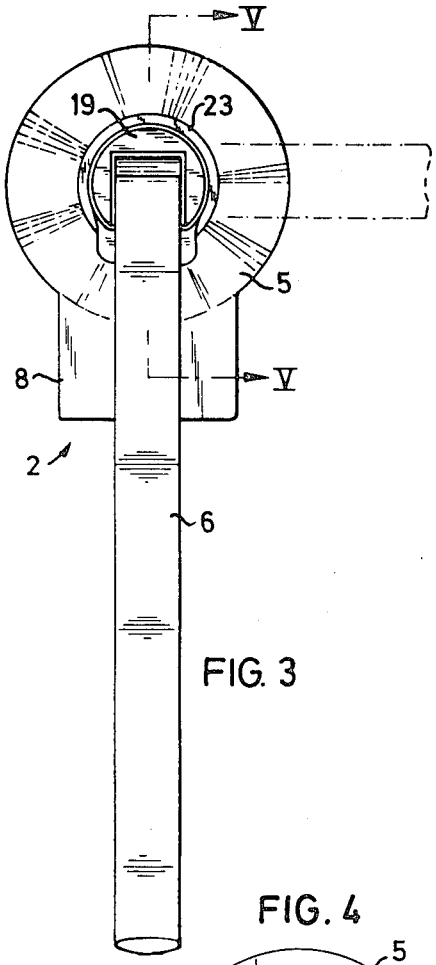
FIG. 3
FIG. 2
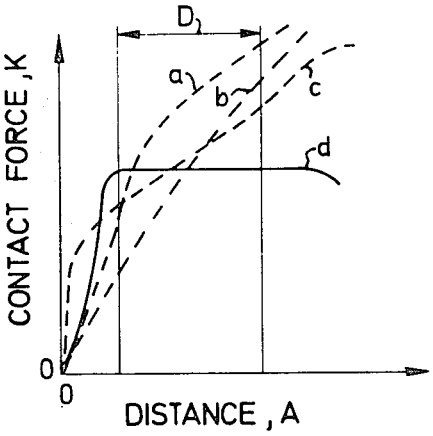
FIG. 4
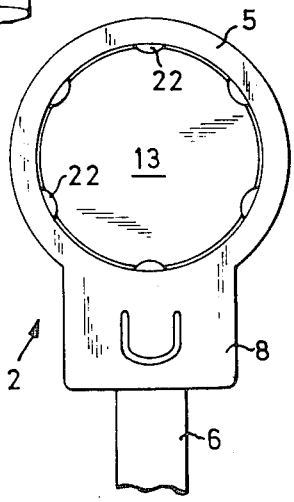

FASTENING MEANS FOR FITTING AN ACCESSORY, ESPECIALLY AN EAR MUFF, TO A SAFETY HELMET

The present invention relates to a fastening means for fitting an accessory, e.g. an ear muff, to a safety helmet or the like where an arm, intended for an accessory, is supported at a pivoting end portion in a housing intended for attaching to the helmet, the arm thus forming a twoarmed lever the pivoting end portion of which, situated in the housing, being acted on by a spring means arranged in the housing to urge the opposite, free end of the arm, situated outside the housing, in a direction towards the head of a wearer.

There are already a great number of different types of fasteners for fitting hearing protectors in the form of ear muffs on safety helmets. One of the disadvantages with known types of such fasteners is that the contact force of the ear muff against the head of the wearer will vary with the swing-out of the arm carrying the ear mufff. Since the width of the head, i.e. the distance between auditory canals in this case, varies between different persons, these persons will be subjected to contact forces of different magnitudes from the ear muff, depending on the size of head they have. The contact force usually increases with increased swing-out of the ear muff, this force then being felt as too great by an ear muff wearer with a wide head, whereas to an ear muff wearer with a narrower head it feels comfortable. To solve this problem, it has been usual to provide the fastening means with some kind of adjusting means to alter the contact force according as the desire of the wearer.

An essential factor for wearers of ear muffs is that the noise-muffling ability of the muff varies with the contact force, and can be seriously reduced for too small a force, so that the muffs do not serve their purpose. From the aspect of worker safety, the utilization of fastening means without adjustment for the contact force is therefore striven for today, to avoid that in practice ear muffs do not lose their function because the contact force is set too low. Due to the way of designing the fastening means up to now, this has led to the wearer having problems with comfort.

The object of the invention is to eliminate the disadvantages with known fastening means and to provide a compact fastening means which, without adjustment, gives substantially the same contact force for different wearers, irrespective of their head size.

This is achieved in accordance with the invention in that the pivoting end portion of the arm has a contact portion for bearing against the convex side of the central portion of the spring means, which is of the disc type and which is retained at its periphery to the side of the housing intended to face towards the outside of the helmet, the force of the spring means having a line of action essentially perpendicular to the intended plane of contact between the helmet and the housing.

In an advantageous embodiment, the line of action of the spring force has decreasing leverage to the pivoting location of the arm in the housing for increasing outward swing of the arm, the magnitude of the pivoting moment caused by the spring means on the arm being essentially constant within a normal range of swing-out for the arm when in use.

In this manner, the same type of fastening means can be used without any alterations for a great number of individuals to give a contact force suitably adjusted to the noise-muffling properties of the ear muff. The fastening means can furthermore be made with small dimensions and only slightly projecting from the helmet.

Figure 6:
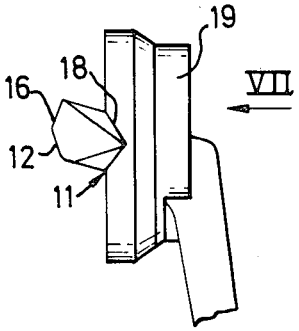
Figure 7:
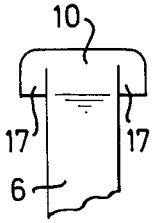
Figure 8:
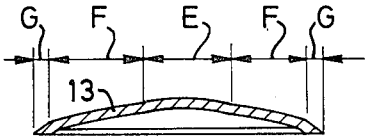
Figure 9:
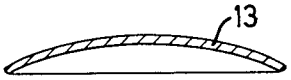
Figure 10:
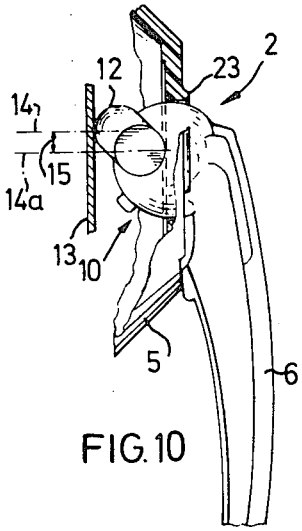
Figure 11:
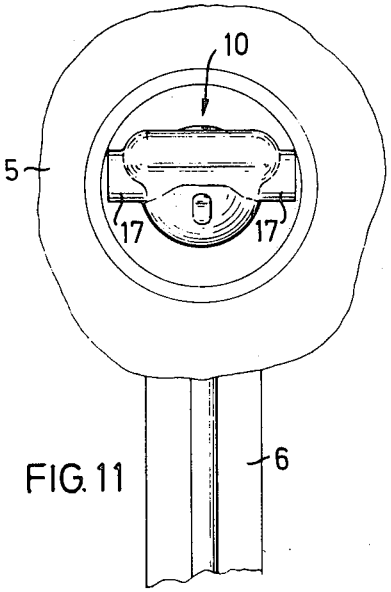

The invention will now be described by reference to the accompanying drawings, in which:

FIG. 1 is a view illustrating an ear muff fitted to a safety helmet by means of a fastening means in accordance with the invention, FIG. 2 is a diagram showing the relationship between contact force and distance from an inactive position for an ear muff fitted by means of the fastening means, FIG. 3 illustrates the fastening means seen from the front, FIG. 4 illustrates the fastening means seen from behind, FIG. 5 is a section along the line V—V in FIG. 3, FIG. 6 is a side view of the mounting arrangement of the arm, FIG. 7 is a front view of the upper end of the arm, seen in the direction of the arrow VII in FIG. 6, FIGS. 8 and 9 show cross sections through different embodiments of the spring means, FIG. 10 is a section, similar to that in FIG. 5, through a different embodiment, and FIG. 11 is a view from the left in FIG. 10.

According to FIG. 1, a safety helmet 1 is provided with a fastening means 2 for a hearing protector 3 in the form of an ear muff, which is pressed against the head 4 of a wearer. The fastening means 2 comprises a housing 5 with an arm 6 pivotably mounted therein, the arm carrying the ear muff 3 via a holder 7. The housing 5 is fixed by a locking portion 8 into a locking means 9, of a type now customary, on the safety helmet 1.

When an ear muff is to be used, it will be swung out from an inactive position a certain distance so that a desired contact force against the head is obtained. For known types of fastening means, the contact force will increase with the amount of swing-out from the inactive position, as is apparent from the curves a, b and c in FIG. 2, where the contact force K has been schematically drawn as a function of the distance A from the inactive position. However, there will be a completely different course for the curve d pertaining to a fastening means in accordance with the invention and representing the relationship between the contact force K and the distance A. As is apparent from FIG. 2, the curve d will flatten out at a certain level, i.e. the contact force K will remain substantially constant for different distances A, within a comparatively large range. The distance D in FIG. 2 represents a typical interval between the distances the ear muff 3 needs to move for different widths of head.

It is known by experience that the width of the head for different individuals, measured between the openings of the auditory canals, varies between 130 and about 170 mm, and thus the two ear muffs on a safety helmet must together cover an interval of about 40 mm to suit different individuals. This signifies a variation of about 20 mm for each ear muff. To be on the safe side, the interval D should, however, be larger than 20 mm, suitably about 30–40 mm. The fastening means in accordance with the invention thus enables a contact force varying insignificantly with increased swing-out, which in turn enables optimum adjustment of the contact force from the noise-damping aspect. The earlier large variations in contact force resulting from varying swing-out are avoided.

The arm 6 with its pivoting end portion 10 at an angle to the rest of the arm is mounted in the housing 5 at a mounting or pivoting location 11. The arm 6 thus forms a two-armed lever, the pivoting end portion 10 of which situated in the housing 5 actuates, via a contact portion 12, a spring means 13 fitted in the housing 5, said spring means urging the opposite free end of the arm 6, situated outside the housing 5, in a direction towards the head of the wearer.

As will be seen from FIG. 5, the line of action 14 of the spring force has a decreasing leverage 15 to a line 14*a* through the pivoting location 11 for an increasing outward swing of the arm. The spring force increases, however, for increased arm swing-out, so that the product of the leverage 15 and spring force on the arm, i.e. the pivoting moment exercised on the arm 6 by the spring means 13, is substantially constant within a swing-out range which is normal for the arm 6 in use. When the arm 6 is swung out, the contact portion 12 glides on a central portion on the convex side of the spring means 13, suitably formed like a conical disc spring. To advantage, the contact portion 12 can be provided with a positioning surface 16, which will bear against the spring means 13 such that the pivoting moment acting on the arm becomes zero for a sufficiently large swing-out of the arm 6, whereby the arm 6 can be positioned in a given swung-out position, which is an advantage, e.g. for oral communication with the wearer of the ear muff.

The pivoting end portion 10 of the arm 6 has two knifeedge type supports 17, one on either side of the arm, which together with groove-like recesses 18 in the housing form the pivoting location 11. The groove-like recesses 18 can possibly be arranged on the inside of the housing itself, but it is advantageous, as illustrated here, to make the groove-like recesses 18 in a mounting piece 19 incorporated in the housing 5, the piece 19 together with the arm being rotatable relative to the remainder of the housing about an axis substantially perpendicular to the contact surface between housing and helmet. There is a through-opening 20 in the mounting piece 19 for the pivoting end portion 10, and in said opening there is suitably a stop surface 21 limiting the swing-out of the arm 6.

The pivoting location 11 can naturally be formed in other ways, e.g. with the aid of a pin going through the pivoting end portion 10 and into the mounting piece 19, or directly into the housing 5. The embodiment illustrated here has, however, the advantage of being fitted very simply.

The spring means 13 is retained in the housing 5 by means of a plurality of fixing elements 22 round its periphery. In the case illustrated, the fixing elements 22 comprise a plurality of projections on the housing 5, which are deformed after locating the spring means 13. Other methods of fitting are also possible. For example, a special locking ring, fixing the edge portion of the locking means, can be screwed into or otherwise fixed to the housing 5. Alternatively, the housing can be made in halves which are joined together after fitting the spring means.

When the arm 6 is pivoted, the contact portion 12 will press in the curved, central portion of the spring means 13. In order to obtain a suitable spring characteristic for the spring means 13, which is suitably made from steel and has the shape of a dished washer with a thickness of about 0.6 mm, it has been found practicable to form the portion of the spring means 13 within the area E in FIG. 8 with a smaller radius of curvature than the annular portion situated in the regions F. Furthermore, it has been found suitable to give the edge portion of the spring means 13, situated within the areas G in FIG. 8, the form of the conical surface of a truncated cone to obtain a good spring characteristic. It is naturally also possible to use other embodiments of the spring means 13, e.g. with a constant radius of curvature, as shown in FIG. 9. A still further possibility is to use a spring means with varying thickness to obtain the desired spring characteristic.

For the fastening means to function well, it is essential that the friction between the contact portion 12 and the spring means 13 is low. Furthermore, the mounting piece 19 must be easily rotatable in the housing 5, so that the arm 6 can be rotated, after it has been swung out sufficiently, to a "parking position", or inactive position, indicated by dashed lines in FIG. 3, where the inside of the arm rests against an edge portion 23 arranged on the housing 5, said portion at least partially surrounding the mounting piece 19. An ear muff 3 can thus be rotated round to a parking position on the safety helmet 1, simultaneously as it is prevented from contacting the outside of the helmet, the cushion portion on the ear muff intended for contact against the head thus being protected.

The spring means 13 is suitably made from steel, while remaining parts can to advantage be made from plastics, e.g. amide or acetal plastics, possibly with some kind of fibre reinforcement. It is naturally possible to make all the parts in metal also, in which case it should be ensured that the friction between the moving parts is reduced in a suitable way, e.g. by covering with friction-reducing plastics or in some other suitable way.

A different embodiment is shown in FIG. 10 and FIG. 11. Here, the mounting piece 19 has been eliminated, and the supports 17, which are rounded, are in direct contact with the inside of the housing 5. The pivoting end portion 10 of the arm 6 has a ball-shaped portion 24 which provides a ball joint type mounting of the arm 6 in the housing 5. When the arm 6 is pivoted outwards, the line of action 14 for the spring force will gradually move downwards, as seen in FIG. 10, to finally arrive at a position below the line 14*a* through the pivoting location 11. In this position a stop 25 on the portion 24 comes in contact with the inside of the housing 5 and prevents further movement of the arm 6, which is now in a position resting away from the wearer's head.

What I claim is:

1. A fastening means for fitting an accessory, e.g. an ear muff, on a safety helmet or the like, where an arm, intended for an accessory, is supported at a pivoting end portion in a housing intended for attaching to the helmet, the arm thus forming a two-armed lever, the pivoting end portion of which, situated in the housing, being acted on by a spring means having a convex side, said spring means arranged in the housing, to urge the opposite, free end of the arm, situated outside the housing, in a direction towards the head of the wearer, characterized in that the pivoting end portion of the arm has a contact portion for bearing against the central portion of the convex side of the spring means, which is of the disc type and which is retained at its periphery to the side of the housing intended to face towards the outside of the helmet, the force of the spring means having a line of action essentially perpendicular to the intended plane of contact between the helmet and the housing.

2. A fastening means as claimed in claim 1, characterized in that the line of action of the spring force has decreasing leverage to the pivoting location of the arm in the housing for increasing outward swing of the arm, the magnitude of the pivoting moment caused by the spring means on the arm being essentially constant within a normal range of swing-out for the arm when in use.

3. A fastening means as claimed in claim 1, characterized in that the arm is pivotably supported in the housing by means of two supports, arranged on either side of the arm, said supports each coacting with the inside of the housing.

4. A fastening means as claimed in claim 3, characterized in that the arm is supported in the housing via a mounting piece, which together with the arm is rotatable in the housing.

5. A fastening means as claimed in claim 1, characterized in that the arm is provided with means for positioning the arm in a certain swing-out position.

6. A fastening means as claimed in claim 1, characterized in that on the outside of the housing, at the location where the arm runs through an opening in the housing, there is provided an edge portion at least partially surrounding said opening, the arm being intended to rest against said edge portion when it is moved away from its normal position of use and is rotated to a parking position.

7. A fastening means as claimed in claim 1, characterized in that the central portion of the spring means has a radius of curvature which is smaller than the surrounding portion of said spring means.

8. A fastening means as claimed in claim 1, characterized in that the spring means has an edge portion in the form of the curved surface of a truncated cone.

9. A fastening means as claimed in claim 1, characterized in that the spring means is preferably of steel, while remaining parts are preferably of plastics.

* * * * *